US005893658A

United States Patent [19]

Kellie et al.

[11] Patent Number: 5,893,658

[45] Date of Patent: Apr. 13, 1999

[54] IMAGE PLANE REGISTRATION SYSTEM FOR ELECTROGRAPHIC SYSTEMS

[76] Inventors: Truman F. Kellie; William D. Edwards; Michael R. Bury, all of P.O. Box 64898, St. Paul, Minn. 55164-0898

[21] Appl. No.: 08/953,303

[22] Filed: Oct. 17, 1997

[51] Int. Cl.[6] ..... G03G 15/01

[52] U.S. Cl. ..... 399/40; 399/231

[58] Field of Search ..... 399/38, 40, 51, 399/159, 160, 178, 222, 228, 231, 233, 237, 251, 252; 347/115, 116

[56] References Cited

U.S. PATENT DOCUMENTS

| | | | |
|---|---|---|---|
| 3,411,936 | 11/1968 | Rotsman et al. . | |
| 3,832,170 | 8/1974 | Nagamatsu et al. . | |
| 4,578,331 | 3/1986 | Ikeda et al. . | |
| 4,611,901 | 9/1986 | Kohyama et al. | 399/231 |
| 4,728,983 | 3/1988 | Zwadlo et al. . | |
| 4,877,698 | 10/1989 | Watson et al. . | |
| 5,089,847 | 2/1992 | Folkins | 399/231 X |
| 5,175,564 | 12/1992 | Jamzadeh | 347/116 |
| 5,278,625 | 1/1994 | Charnitski et al. | 399/178 |
| 5,300,990 | 4/1994 | Thompson . | |
| 5,355,153 | 10/1994 | Yasuda . | |
| 5,420,673 | 5/1995 | Itoh | 399/251 |
| 5,420,675 | 5/1995 | Thompson et al. . | |
| 5,552,869 | 9/1996 | Schilli et al. . | |
| 5,576,815 | 11/1996 | Teschendorf et al. . | |
| 5,596,398 | 1/1997 | Woo et al. . | |
| 5,650,253 | 7/1997 | Baker et al. . | |
| 5,652,078 | 7/1997 | Jalbert et al. . | |
| 5,652,282 | 7/1997 | Baker et al. . | |
| 5,659,855 | 8/1997 | Stelter et al. | 347/116 X |
| 5,697,009 | 12/1997 | Muroki et al. | 399/40 |
| 5,713,068 | 1/1998 | Teschendorf et al. . | |
| 5,722,009 | 2/1998 | Haneda et al. | 399/40 X |
| 5,754,928 | 5/1998 | Moe et al. . | |

FOREIGN PATENT DOCUMENTS

WO 97/12287 4/1997 WIPO .

OTHER PUBLICATIONS

"Imaging Processes and Materials," Neblette's Eighth Edition, Edited by Sturge, Von Nostrand Reinhold Publishers, New York, 1989, pp. 3, 7–8.

*Primary Examiner*—Sandra L. Brase
*Attorney, Agent, or Firm*—William K. Weimer

[57] ABSTRACT

A method and apparatus for minimizing image banding and for registering multiple image planes of a single image on a receptor drum in electrographic systems. The system for registering multiple image planes of a single image in an electrographic system includes a receptor drum capable of capturing two or more overlaying image planes, an exposure device for forming overlaying image planes on the receptor drum, and at least one developer station transferring a developer to the receptor drum corresponding to each of the overlaying image planes. A measuring device is provided for measuring the rotational position of the receptor drum. A drive mechanism is provided for controlling a motor coupled to the receptor drum by at least one drive belt. A closed loop positioning system is coupled to the measuring device and the drive mechanism. The closed loop positioning system is capable of modulating the angular velocity of the receptor drum to achieve image plane registration of the two or more image planes. The system is capable of achieving image plane registration error of preferably about 100 micrometers or less, more preferably about 50 micrometers or less, and most preferably about 20 micrometers or less. The system is capable of achieving image plane registration error of about ±0.5 scan lines or less.

41 Claims, 5 Drawing Sheets

IMAGE PLANE REGISTRATION SYSTEM FOR ELECTROGRAPHIC SYSTEMS

FIELD OF THE INVENTION

The present invention relates generally to an image plane registration system for electrographic systems, and more specifically to a method and apparatus for minimizing image banding and for registering multiple image planes to form a single image on a receptor drum in electrographic systems.

BACKGROUND OF THE INVENTION

Electrographic processes enable the production of high quality images on a receiving material, such as film or paper. Electrographic devices which may utilize electrophotography include conventional laser printers, photocopiers, proofers, etc.

In conventional electrophotographic systems, a photoreceptor is supported by a mechanical carrier such as a drum or a belt. First, the photoreceptor is erased by exposure to an erase lamp which "bleeds" away any residual charge remaining on the photoreceptor from previous operations. The photoreceptor then is charged to a generally uniform charge, positive or negative, by subjecting the photoreceptor to a suitable charging device such as a corona or a charging roll. The charge distribution on the photoreceptor is then altered by the image-wise application of radiation, e.g., a laser, to the surface of the photoreceptor, creating a latent image corresponding to the image-wise application of radiation on the photoreceptor. Toner is attracted to the photoreceptor in a pattern consistent with the charge distribution on the photoreceptor. The toner is then typically transferred, either directly or through an intermediate medium, from the photoreceptor to a receiving medium being printed upon, e.g., paper or film.

Monochrome printers produce a hard copy output in one toner color only, typically black. If the printer is to be used to print a different color, the conventional black toner cartridge is removed and replaced with a toner cartridge containing toner of another color, e.g., red. However, the printer still prints only a single color.

On the other hand, color printers use three primary colors, typically cyan, magenta and yellow, and in addition, optionally, black. Several techniques have been developed over the years to adapt electrophotographic techniques to use multiple colors.

U.S. Pat. No. 3,832,170 (Nagamatsu et al.), entitled Method of and Apparatus for Electronic Color Photography and Photosensitive Member Used for the Same, discloses a photosensitive member consisting basically of a supporting base, a photoconductive layer and an insulating layer dyed in a desired color for providing a color filter effect. Such photosensitive members having different color effects are provided for polychromatic reproduction on a single transferable material. Thus, the method disclosed in Nagamatsu et al. requires a separate photosensitive member for each primary color plane. Not only is this method costly and bulky but significant color plane registration problems often occur due to the necessity of the transfer of the final image from multiple photosensitive members.

U.S. Pat. No. 4,578,331 (Ikeda et al.), entitled Color Image Forming Method, discloses an electrophotographic color image forming process wherein three light beams, each representing image information of one of three primary colors of a color document to be recorded obtained by color separation, are projected against an electrophotographic photosensitive member to form electrostatic latent images which are developed by toner of the three different colors, respectively, and printed by transfer printing, to record a color image. The image information of three colors is simultaneously written to a surface of the photosensitive member as three scanning lines either by successively writing a plurality of sets of three scanning lines each representing image information of one color or by writing image information of different colors of the same set separately in three different zones, so that the scanning lines representing image information of different colors form a repeating series of three stripes of different colors. The electrostatic latent images formed on the scanning lines are developed by the toners of respective colors to produce toner images of different color which are printed by transfer printing on a transfer printing sheet. Because the method disclosed in Ikeda et al. prints dry, opaque toners in separate zones, or scan lines, this system is limited in the resolution that can be provided. This loss of resolution is caused directly by the interleaving of the color planes within the page.

U.S. Pat. No. 4,728,983 (Zwadlo et al.), entitled Single Beam Full Color Electrophotography, discloses a method of making high quality color prints by electrophotography. A single photoconductive drum is used together with means to erase, electrostatically charge, laser-scan expose and toner develop during a single rotation of the photoconductive drum. In successive rotations, different colored images corresponding to color separation images are assembled in register on the drum. This assembled color image is transferred to a receiving sheet in a final rotation of the drum. Because a separate pass, i.e., rotation, is required for each primary color plane, at least four passes (rotations) are needed to obtain the final four color image print. Separate passes for each of the primary color planes significantly restricts the speed which a multiple color electrophotographic printing process can achieve.

U.S. Pat. No. 4,877,698 (Watson et al.), entitled Electrophotographic Process for Generating Two-Color Images Using Liquid Developer, discloses a process and apparatus for generating two-color images by charging an imaging member in an imaging apparatus, creating on the member a latent image comprising areas of high, intermediate, and low potential, providing an electrode having a potential within about 100 volts of that of the intermediate potential, enabling generation of an electric field and a development zone between the imaging member and the electrode, and developing the latent image by introducing into the development zone a liquid developer composition containing first toner particles of one color and second toner particles of another color, the particles being dispersed in a liquid medium, wherein the second toner particles are attracted to the high potential and the first toner particles are attracted to the low potential. The process and apparatus disclosed in Watson et al. achieves a two-color image in a single pass, indeed a single developing step, but is limited to a maximum of two colors. Thus, this system would not be suitable for a standard four color image.

BRIEF SUMMARY OF THE INVENTION

The present invention relates to a method and apparatus for minimizing image banding and for registering multiple image planes to form a single image on a receptor drum in electrographic systems.

In one embodiment, the system for registering multiple image planes to form a single image in an electrographic system includes a receptor drum capable of capturing two or more overlaying image planes, an exposure device for forming overlaying image planes on the receptor drum, and at least one developer station transferring a developer to the receptor drum corresponding to each of the overlaying image planes. A measuring device is provided for measuring the rotational position of the receptor drum. A drive mechanism is provided for controlling a motor coupled to the receptor drum by at least one drive belt. A closed loop positioning system is coupled to the measuring device and the drive mechanism. The closed loop positioning system is capable of modulating the angular velocity of the receptor drum to achieve image plane registration of the two or more image planes. The system is capable of achieving image plane registration error of preferably about 100 micrometers or less, more preferably about 50 micrometers or less, and most preferably about 20 micrometers or less. In one embodiment, the system is capable of achieving image plane registration error of about ±0.5 scan lines or less.

The system can form one image plane for each rotation of the receptor drum. The overlaying image planes may comprise preferably at least three, and more preferably at least four image planes each formed during separate rotations of the receptor drum.

In one embodiment, the electrographic system comprises an electrophotographic system and the receptor drum comprises a photoreceptor drum. In another embodiment, the electrographic system comprises an electrostatic system and the receptor drum comprises an electrostatic drum. The developer may be either wet or dry developer. The exposure device is typically a rastering laser system.

The system includes a mechanism for engaging and disengaging the developer stations with the receptor drum. The developer stations may include a drying mechanism for substantially transforming developer on the receptor drum into a substantially dry film. The measuring device is typically an optical encoder.

The closed loop positioning system includes a calibration table correlating the location of scan lines on the receptor drum from the exposure device with a position pulse from the measuring device. In one embodiment, the calibration table is generated during formation of a first overlapping image plane. The closed loop positioning system is capable of comparing an actual position of the receptor drum as measured by the measuring device with a predicted position of the receptor drum from the calibration table to calculate a velocity correction to achieve image plane registration. The system includes a transfer mechanism for transferring the two or more image planes from the receptor drum to a receiving medium.

The present invention is also directed to a method for registering multiple image planes of a single image in an electrographic system. The method includes rotating a receptor drum while measuring its rotational position. An exposure device is directed to the rotating receptor drum to form a first image plane. A first developer station is engaged with the receptor drum to transfer a first developer to the photoreceptor drum corresponding to the first image plane. The first developer is transformed on the receptor drum into a substantially dry film. The exposure device is again directed to the rotating receptor drum to form a second overlaying image plane. The angular velocity of the photoreceptor drum is modulated to achieve image plane registration of the second image plane with the first image plane. A second developer station is engaged with the receptor drum to transfer a second developer to the photoreceptor drum corresponding to the second image plane. The second developer is transformed on the photoreceptor drum into a substantially dry film.

The method includes the step of coupling a closed loop positioning system to a measuring device on the receptor drum and a drive mechanism for rotating the receptor drum. The closed loop positioning system achieves image plane registration error of preferably about 100 micrometers or less, more preferably about 50 micrometers or less, and most preferably about 20 micrometers or less. The closed loop positioning system achieves image plane registration error of about ±0.5 scan lines or less.

The exposure device typically forms one image plane for each rotation of the receptor drum. For example, the first image plane is formed during a first rotation of the receptor drum and the second image plane is formed during a second rotation of the receptor drum. The method also includes the step of transferring the dry developer from the first and second image planes from the receptor drum to a medium.

The method may optionally include the steps of directing an exposure device to the rotating receptor drum to form a third overlaying image plane. The angular velocity of the receptor drum is modulated to achieve image plane registration of the third image plane with the first and second image planes. A third developer station is engaged with the receptor drum to transfer developer to the receptor drum corresponding to the third image plane. Developer on the photoreceptor drum is transformed into a substantially dry film.

In another embodiment of the invention, an exposure device is directed to the rotating receptor drum to form a fourth overlaying image plane. The angular velocity of the receptor drum is modulated to achieve image plane registration of the fourth image plane with the first, second and third image planes. A fourth developer station is engaged with the photoreceptor drum to transfer developer to the receptor drum corresponding to the fourth image plane. Developer on the photoreceptor drum is transformed into a substantially dry film.

The method includes rotating the receptor drum during a calibration cycle, correlating a location of scan lines on the receptor drum with position pulses from a measuring device, and storing correlated position data in a calibration table. The actual position of the receptor drum can be compared with correlated position data in the calibration table. A velocity correction can be calculated to achieve image plane registration. The velocity of the receptor drum is changed to register the image planes. In one embodiment, the calibration table is generated during formation of a first overlapping image plane.

Developer refers to liquid inks, dry powder inks and toners.

Electrographic refers to electrophotographic and electrostatic imaging systems using either wet or dry developers.

Image Plane Registration refers to alignment of individual or discrete image planes with an error of about 100 micrometers or less.

Receptor Material refers to a variety of electrographic imaging materials such as electrophotographic and/or electrostatic imaging materials.

Substantially Dry Film refers to an ink with about 75% solids or greater.

BRIEF DESCRIPTION OF THE SEVERAL VIEW OF THE DRAWINGS

The foregoing advantages, construction and operation of the present invention will become more readily apparent from the following description and accompanying drawings in which.

DETAILED DESCRIPTION OF THE INVENTION

Figure 1:
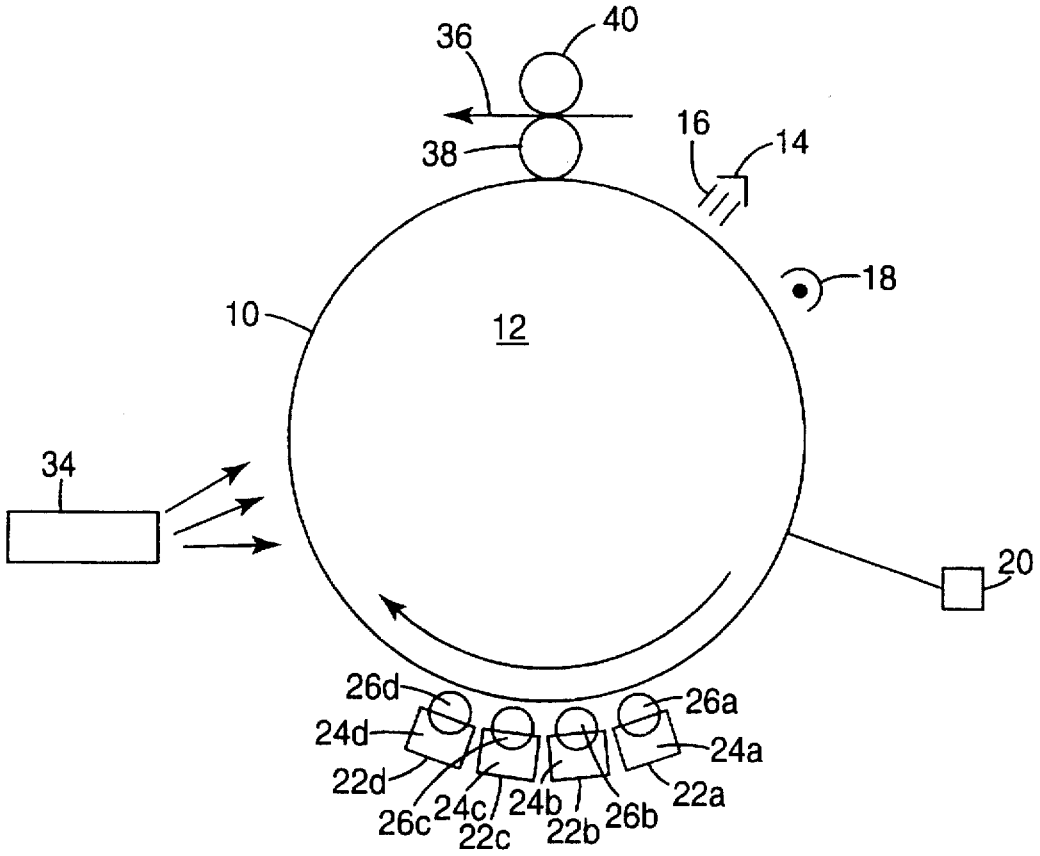
FIG. 1 is a diagrammatic illustration of an exemplary electrographic apparatus.

The present invention is directed to an electrographic system with an image registration system. The image data is transmitted to a receptor material. A developer is deposited on the receptor material corresponding to the image data. The developer is then transferred to a medium, such as paper. Although the illustrated embodiment is a liquid electrophotographic system for producing a multi-color image, it will be understood that the present invention has application for any electrographic system.

Liquid electrophotography is a technology which produces or reproduces an image on paper or other desired receiving medium. Liquid electrophotography uses developers which may be black or which may be of different colors for the purpose of plating solid material onto a surface in a well-controlled and image-wise manner to create the desired prints. Typically, developers used in electrophotography are substantially transparent or translucent to radiation emitted at the wavelength of the latent image generation device so that multiple image planes can be laid over one another to produce a multi-colored image constructed of a plurality of image planes with each image plane being constructed with a developer of a particular color.

Typically, a colored image is constructed of four image planes. The first three planes are constructed with a developer in each of the three subtractive primary printing colors, yellow, cyan and magenta. The fourth image plane uses a black developer which need not be transparent to radiation emitted at the wavelength of the latent image generation device. Various methods and devices for electrophotography are disclosed in PCT publication No. WO 97/12287 (U.S. Ser. No. 08/536,418) entitled Single Pass Electrophotographic System Which Coordinates the Driving of a Photoreceptor with a Plurality of Exposure Locations, published on Apr. 3, 1997, and U.S. Pat. No. 5,355,153 (Yasuda).

In the illustrated embodiment, the process involved in liquid electrophotography can be illustrated with reference to FIG. 1. Light sensitive, receptor material 10 is arranged on or near the surface of a mechanical carrier such as drum 12. Drum 12 rotates in the clockwise direction of FIG. 1 moving a given location of receptor material 10 past various stationary components which perform an operation relative to receptor material 10 or an image formed on drum 12. In the illustrated embodiment, the drum 12 is typically about 160 millimeters in diameter, although other drum sizes would suffice, e.g., a 75 centimeter diameter drum.

Of course, other mechanical arrangements could be used which provide relative movement between a given location on the surface of receptor material 10 and various components which operate on or in relation to receptor material 10. For example, receptor material 10 could be stationary while the various components move past receptor material 10 or some combination of movement between both receptor material 10 and the various components could be facilitated. It is only important that there be relative movement between receptor material 10 and the other components. As this description refers to receptor material 10 being in a certain position or passing a certain position, it is to be recognized and understood that what is being referred to is a particular spot or location on receptor material 10 which has a certain position or passes a certain position relative to the components operating on receptor material 10.

In FIG. 1, as drum 12 rotates, receptor material 10 moves past erase lamp 14. When receptor material 10 passes under erase lamp 14, radiation 16 from erase lamp 14 impinges on the surface of receptor material 10 causing any residual charge remaining on the surface of receptor material 10 to "bleed" away. Thus, the surface charge distribution of the surface of receptor material 10 as it exits erase lamp 14 is quite uniform and nearly zero depending upon the photoreceptor.

As drum 12 continues to rotate and receptor material 10 next passes under charging device 18, a uniform positive or negative charge is imposed upon the surface of receptor material 10. In a preferred embodiment, the charging device 18 is a positive DC corona. Typically, the surface of receptor material 10 is uniformly charged to around 600 volts depending on the capacitance of the photoreceptor. Charging prepares the surface of receptor material 10 for an image-wise exposure to radiation by laser scanning device 20 as drum 12 continues to rotate.

Wherever radiation from laser scanning device 20 impinges on the surface of receptor material 10, the surface charge of receptor material 10 is reduced significantly while areas on the surface of receptor material 10 which do not receive radiation are not appreciably discharged. Areas of the surface of receptor material 10 which receive some radiation are discharged to a degree that corresponds to the amount of radiation received. This results in the surface of receptor material 10 having a surface charge distribution which is proportional to the desired image information imparted by laser scanning device 20 when the surface of receptor material 10 exits from under laser scanning device 20.

As drum 12 continues to rotate, the surface of receptor material 10 engages with one of the developer stations **22*a*–22*d*, each corresponding to a primary color (i.e., yellow, magenta, cyan) and optionally black. The present method and apparatus may also be used for aligning multiple image planes of the same color. The operation of individual developer stations 22a–22d** can be more readily understood by reference to FIG. 2.

The first color plane is developed by bringing the developer station 22a into position adjacent the receptor material 10. The other three developer stations 22b–22d preferably do not engage with the photoreceptor during development of the first color plane. Developer 24a is applied to the surface of image-wise charged receptor material 10 in the presence of an electric field which is established by placing electrode 26a, illustrated as a roller, near the surface of receptor material 10 and imposing a bias voltage on electrode 26a. Developer 24a consists of positively charged "solid," but not necessarily opaque, toner particles of the desired color for this portion of the image being printed. The "solid" material in the liquid developer, under force from the established electric field, migrates to and plates upon the surface of receptor material 10 in areas 28a where the surface voltage is less than the bias voltage of electrode 26a. The "solid" material in the liquid developer will migrate to and plate upon the electrode in areas 30 where surface voltage of receptor material 10 is greater than the bias voltage of electrode 26a. Excess developer not sufficiently plated to either the surface of receptor material 10 or to electrode 26a is removed. The method for removing excess developer in the illustrated embodiment is using the "crowned squeegee roller" described in U.S. Patent Application entitled Squeegee Apparatus and Method for Removing Developer Liquid From an Imaging Substrate and Fabrication Method, U.S. Ser. No. 08/811,660 filed Mar. 4, 1997.

The developer is dried by drying mechanism 32a which may include a roll, vacuum box or curing station. Drying mechanism 32a substantially transforms developer 24a into a substantially dry film. The excess developer 24a then returns to developer station 22a for use in a subsequent operation. The "solid" portion 28a (film) of developer 24a plated upon the surface of receptor material 10 matches the previous image-wise charge distribution previously placed upon the surface of receptor material 10 by laser scanning device 20 and, hence, is an image-wise representation of the desired image to be printed.

Film 28a from developer station 22a is further dried by drying mechanism 34. Drying mechanism 34 may be passive, may utilize active air blowers, heater, vacuum, coronas, or may be other active devices such as rollers. In a preferred embodiment, drying mechanism 34 is a drying roll or image conditioning roller. Such an apparatus is described in U.S. Pat. No. 5,420,675, which is hereby incorporated by reference.

At this stage, receptor material 10 contains on its surface an image-wise distribution of plated "solids" of developer 28a in accordance with a first color plane. The surface charge distribution of receptor material 10 has also been recharged with plated developer particles as well as with transparent counter-ions from developer 24a both being governed by the image-wise discharge of receptor material 10 due to laser scanning device 20. Thus, at this stage the surface charge of receptor material 10 is also quite uniform. Although not all of the original surface charge of photoreceptor may have been obtained, a substantial portion of the previous surface charge of photoreceptor has been recaptured. With such solution recharging, receptor material 10 is now ready to be processed for the second color plane of the image to be reproduced.

Although not required, a "topping charge" is typically applied to receptor material 10 by the charging device 18 following application of developer to the first three image planes (e.g., developer stations 22a–22c). While receptor material 10 recharges following development with developers 24a–24c, it typically does not recharge completely to the previously charged voltage. Thus, as the drum 12 continues to rotate, a uniform positive or negative charge is imposed upon the surface of receptor material 10 by the charging device 18 to bring the voltage on receptor material 10 back to a preferred charging level.

The receptor material 10 next is image-wise exposed to radiation from laser scanning device 20 corresponding to a second color plane. Note that this process occurs during a separate revolution of receptor material 10 on the drum 12. The remaining charge on the surface of receptor material 10 is subjected to radiation corresponding to a second color plane. This produces an image-wise distribution of surface charge on receptor material 10 corresponding to the second color plane of the image.

The second color plane of the image is then developed by bringing the developer station 22b containing developer 24b into engagement with the receptor material 10. Although developer 24b contains "solid" color pigments consistent with the second color plane, developer 24b also contains substantially transparent counter-ions which, although they may have differing chemical compositions than substantially transparent counter-ions of developer 24b, still are substantially transparent and oppositely charged to the "solid" color pigments. Electrode 26b provides a bias voltage to allow "solid" color pigments of developer 24b to create a pattern of "solid" color pigments 28b on the surface of receptor material 10 corresponding to the second color plane. The developer is dried by drying mechanism 32b. The plated solids from developer 24b are dried in a drying mechanism 34. The transparent counter-ions also substantially recharge receptor material 10 and make the surface charge distribution of receptor material 10 substantially uniform so that another color plane may be placed upon receptor material 10. A topping charge is typically applied by the charging device 18.

A third color plane of the image is reproduced by first corona charging the receptor material 10. The third image plane is deposited on the surface of receptor material 10 in similar fashion using laser scanning device 20 and developer station 22c containing developer 24c using electrode 26c. Electrode 26c provides a bias voltage to allow "solid" color pigments of developer 24c to create a pattern of "solid" color pigments 28c on the surface of receptor material 10 corresponding to the third color plane. The developer is dried by drying mechanism 32c. The plated solids from developer 24c are dried in a drying mechanism 34. Again, the surface charge existing on receptor material 10 following development of the third color plane may be somewhat less than existed prior to exposure to laser scanning device 20, but will be substantially "recharged" and will be quite uniform allowing application of the fourth color plane without the necessity of erase or corona charging. A topping charge is typically applied by the charging device 18 before the fourth color plane is written on the drum 12.

Similarly, the "solid" color pigments of developer 24d of the fourth color plane is deposited upon receptor material 10 using laser scanning device 20 and developer station 22d containing developer 24d using electrode 26d. Excess liquid from developer 24d, if any, is "squeezed" off using the roller 32d.

The film 28a–28d portion representing the desired image to be printed is then transferred, either directly to the receiving medium 36 to be printed, or preferably and as illustrated in FIG. 1, indirectly by way of transfer rollers 38 and 40. Transfer is effected by differential tack of film 28*a*–28*d* and transfer rollers 38 and 40. The preferred mechanism for image transfer is disclosed in U.S. Pat. No. 5,650,253 entitled Method and Apparatus Having Improved Image Transfer Characteristics for Producing an Image On a Receptor Medium such as Plain Paper. Typically, heat and pressure are utilized to fuse the image to medium 36. The resultant "print" is a full color hard copy manifestation of the image information written by laser scanning device 22, the colors represented by developers 24*a*–24*d*.

Figure 2:
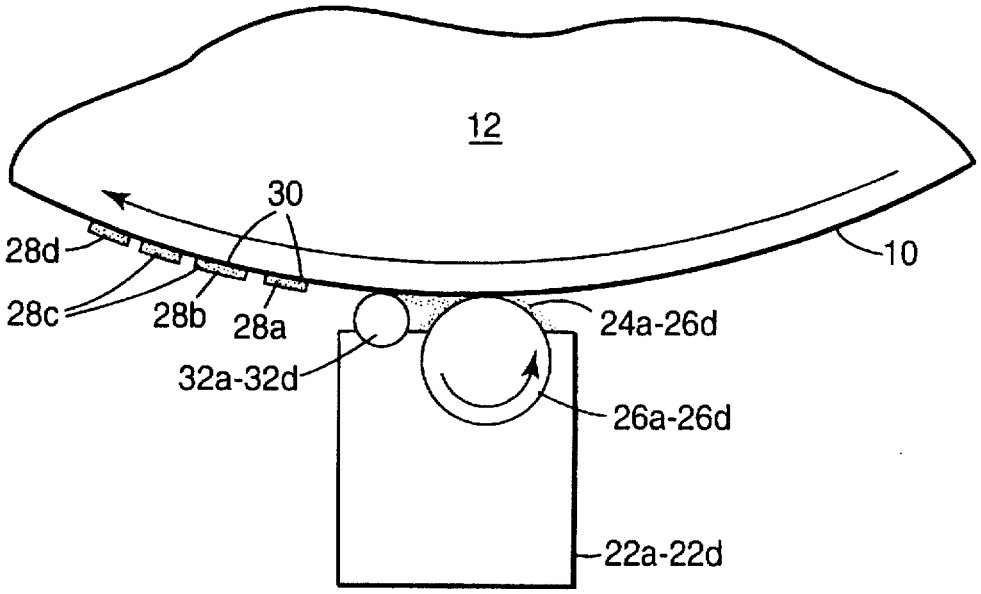
FIG. 2 is an expanded diagrammatic illustration of a single developer station used in the apparatus illustrated in FIG. 1.

While receptor material 10, drum 12, erase lamp 14, charging device 18, laser scanning device 20, developer stations 22*a*–22*d*, developers 24*a*–24*d*, electrodes 26*a*–26*d*, squeegees 32*a*–32*d*, drying mechanism 34 and transfer rollers 38 and 40 have been only diagrammatically illustrated in FIGS. 1 and 2 and only generally described with relation thereto, it is to be recognized and understood that these components are generally well known in the art of electrophotography and the exact material and construction of these elements is a matter of design choice which is also well understood in the art.

The basic electrophotographic process and apparatus described in FIGS. 1 and 2 can be used by repeating the process described above for one color, a number of times wherein each repetition may image-wise expose a separate primary color plane (e.g., yellow, magenta, cyan, and black), and each developer 24 may be of a separate primary printing color corresponding to the image-wise exposed color plane. The order in which the colors of the separate color planes are applied and the order in which the various developer stations 22*a*–22*d* are utilized may vary. Superposition of four such color planes (e.g., yellow, magenta, cyan or black) may be achieved, assuming good registration between the image planes, onto the surface of receptor material 10 without transferring any of the color planes until all have been formed. Subsequent simultaneous transfer of all of these four color planes to a suitable medium 36 can yield a quality color print. See U.S. Pat. No. 4,728,983 (Zwadlo et al.).

With proper selection of charging voltages, photoreceptor capacity and developer, this process may be repeated an indeterminate number of times to produce a multi-colored image having an indeterminate number of color planes. Although the process and apparatus has been described above for conventional four color images, the process and apparatus are suitable for multi-color images having two or more color planes.

Receptor material 10 may be an organic photoconductive layer applied to an electroconductive substrate, an interlayer applied to the photoconductive layer, and a release layer over the interlayer. A preferred embodiment for receptor material 10 is described in Example 6 of U.S. Pat. No. 5,652,078.

Charging device 18 is preferably a scorotron type corona charging device. Charging device 18 has corona wires (not shown) coupled to a suitable positive high voltage source of plus 4,000 to plus 8,000 volts. The grid wires (not shown) of charging device 18 are disposed from about 1 to about 3 millimeters from the surface of receptor material 10 and are coupled to an adjustable positive voltage supply (not shown) to obtain an apparent surface voltage on receptor material 10 in the range, plus 500 volts to plus 1000 volts or more depending upon the capacitance of photoreceptor. While this is the preferred voltage range, other voltages may be used. For example, thicker photoreceptors typically require higher voltages. The voltage required depends principally on the capacitance of receptor material 10 and the charge-to-mass ratio of the developer utilized as the toner for apparatus of FIGS. 1–2. Of course, connection to a positive voltage is required for a positive charging receptor material 10. Alternatively, a negatively charging receptor material 10 using negative voltages would also be operable. The principles are the same for a negative charging receptor material 10.

Laser scanning device 20 includes a suitable source of high intensity electromagnetic radiation. The radiation may be a single beam or an array of beams. The individual beams in such an array may be individually modulated. The radiation impinges, for example, on receptor material 10 as a line scan generally perpendicular to the direction of movement of receptor material 10 and at a fixed position relative to charging device 18.

The radiation scans and exposes receptor material 10, preferably while maintaining exact synchronism with the movement of receptor material 10. The image-wise exposure causes the surface charge of receptor material 10 to be reduced significantly wherever the radiation impinges. Areas of the surface of receptor material 10 where the radiation does not impinge are not appreciably discharged. Therefore, when receptor material 10 exits from under the radiation, its surface charge distribution is proportional to the desired image information.

The wavelength of the radiation to be emitted by laser scanning device 20 is selected to have low absorption through the first three color planes of the image, typically in the order of yellow, magenta and cyan. The fourth image plane is typically black. Black is highly absorptive to radiation of all wavelengths which would be useful in the discharge of receptor material 10. Additionally, the wavelength of the radiation of laser scanning device 20 selected should preferably correspond to the maximum sensitivity wavelength of receptor material 10. A preferred laser scanning device 20 is an infrared diode laser with an emission wavelength over 700 nanometers. Specially selected wavelengths in the visible range may also be usable with some combinations of colorants. The preferred wavelength is about 780 nanometers.

The radiation (a single beam or array of beams) from laser scanning device 20 is modulated conventionally in response to image signals for any single color plane information from a suitable source such as a computer memory, communication channel, or the like. The mechanism through which the radiation from laser scanning devices is manipulated to reach receptor material 10 is also conventional.

The radiation strikes a suitable scanning element such as a rotating polygonal mirror (not shown) and then passes through a suitable scan lens (not shown) to focus the radiation at a specific raster line position with respect to receptor material 10. It will, of course, be appreciated that other scanning means such as an oscillating mirror, modulated fiber optic array, waveguide array, or suitable image delivery system may be used in place of or in addition to a polygonal mirror. For digital halftone imaging, it is preferred that radiation should be able to be focused to diameters of less than 42 micrometers at the one-half maximum intensity level assuming a resolution of 600 dots per inch. A lower resolution may be acceptable for some applications. It is preferred that the scan lens must be able to maintain this beam diameter across at least a 12 inches (30.5 centimeters) width.

In the illustrated embodiment, the polygonal mirror typically is rotated conventionally at constant speed by controlling electronics which may include a brushless DC motor and controller. Receptor material 10 is moved orthogonal to the scan direction velocity by a motor and controller past a raster line where radiation impinges upon receptor material 10. As will be discussed below, the velocity of the drum rotation is varied to achieve registration of the separate color planes to within about 100 micrometers. The ratio between the scan rate produced by the polygonal mirror and receptor material 10 movement speed is maintained constant and selected to obtain the required addressability of laser modulated information and overlap of raster lines for the correct aspect ratio of the final image. For high quality imaging, it is preferred that the polygonal mirror rotation and receptor material 10 speed are set so that at least 600 scans per inch (236 scans/cm), and still more preferably 1200 scans per inch (472 scans/cm), are imaged on receptor material 10. The receptor material 10 typically travels at about 3 inches/second (7.6 centimeters/second).

Conventional developer immersion development techniques can be used in developer stations **22*a*–22*d*. Two modes of development are known in the art, namely deposition of developers 24*a*–24*d* in exposed areas of receptor material 10 and, alternatively, deposition of developers 24*a*–24*d* in unexposed regions. The former mode of imaging can improve formation of halftone dots while maintaining uniform density and low background densities. Although the invention has been described using a discharge development system whereby the positively charged developers 24*a*–24*d* are deposited on the surface of receptor material 10 in areas discharged by the radiation, it is to be recognized and understood that an imaging system in which the opposite is true is also contemplated by this invention. Development is accomplished by using a uniform electric field produced by development electrodes 26*a*–26*d* spaced near the surface of receptor material 10**.

After plating is accomplished by developer electrodes **26*a*–26*d*, squeegee rollers 32*a*–32*d* then rolls over the developed image area on receptor material 10 removing the excess developer 24*a*–24*d* and successively leaving behind each developed color plane of the image. Alternatively, sufficient excess developer remaining on the surface of receptor material 10 could be removed in order to effect film formation by vacuum techniques well known in the art. The developer deposited onto receptor material 10 should be rendered relatively firm (film formed) by the developer electrodes 26*a*–26*d* and squeegee rollers 32*a*–32*d*, or an alternative drying technique in order to prevent it from being washed off in a subsequent developing process(es). Preferably, the developer deposited on receptor material should be dried enough to have greater than seventy percent by volume fraction of solids in the image. Preferred squeegee rollers 32*a*–32*d*** are described in U.S. patent application Ser. No. 08/811,660 entitled Apparatus and Method for Removing Developer Liquid from an Imaging Substrate and Fabrication Method, filed Mar. 4, 1997.

Electrodes **26*a*–26*d* are kept clean by a developer cleaning roller as described in U.S. Pat. No. 5,596,398 entitled Apparatus and Method for Cleaning Developer From an Imaging Substrate. Any further excess developer is removed by an additional roller described in U.S. patent application Ser. No. 08/811,662, entitled Apparatus and Method for Removing Excess Ink from a Imaging Substrate, filed Mar. 4, 1997 (allowed). The overall developer apparatus is described in detail in U.S. Pat. No. 5,576,815, entitled Development Apparatus For A Liquid Electrophotographic Imaging System. Developer stations 22*a*–22*d* are similar to that described in U.S. Pat. No. 5,300,990 (Thompson et al.). The preferred developer stations 22*a*–22*d* differ from those described in the Thompson patent in that the preferred spacing between the surface of the developer rolls 26*a*–26*d* and the surface of receptor material 10 is 150 micrometers (0.15 millimeters) instead of 50–75 micrometers (0.05–0.075 millimeters). Further, no wiper roller is used and squeegee rollers 32*a*–32*d*** are made of urethane.

Once the development process for each color plane of the image is complete, the appropriate developer electrode **26*a*–26*d* is retracted from the surface of receptor material 10, breaking the contact between developers 24*a*–24*d* and the surface of receptor material 10. After the imaged area of receptor material 10 is past squeegee rollers 32*a*–32*d*, a doctor blade (not shown) is brought into contact with the bottom of each squeegee roller. At the same time, squeegee rollers 32*a*–32*d* begin rotating in the direction opposite the moving surface of receptor material 10 with a velocity of approximately 10 inches per second (25.4 centimeters per second). The fluid of developers 24*a*–24*d* in the nip of squeegee rollers 32*a*–32*d* is taken away from the surface of receptor material 10 and skived off squeegee rollers 32*a*–32*d*** by the doctor blade, from which it drains into the fluid return system. The preferred material for the doctor blade is 3M brand Fluoroelastomer FC 2174, which is inert to developer, and is manufactured by Minnesota Mining and Manufacturing Company, St. Paul, Minn.

The image consisting of a cohesive film comprised of four layers of such "solid" color pigments of developers **24*a*–24*d* can be formed into a substantially dry film by using, for example, a drying mechanism 34. Preferably, drying mechanism 34 is a silicone coated roller that absorbs any remaining liquid. Drying mechanism 34 further dries or "conditions" for subsequent transfer, by a drying station described in U.S. Pat. No. 5,552,869, entitled Drying Method and Apparatus for Electrophotography Using Liquid Toners. Although not preferred, drying mechanism 34** may be constructed of a conventional hot air blower or other conventional means.

Following proper drying, the developer image on the surface of receptor material 10 is brought into pressure contact with transfer roller 38 constructed of an elastomer heated to temperature T1. Temperature T1 can be in the range of 25–130 degrees Celsius and, preferably is about 80 degrees Celsius. At temperature T1, the elastomer of transfer roller 38 is tacky. Although a roller is preferred for transfer roller 38, a belt is also envisioned. The developer image adheres to the elastomer of transfer roller 38 when receptor material 10 and the elastomer surface of transfer roller 38 are separated. The surface of receptor material 10 releases the developer image. Subsequently, the developer image bearing elastomer of transfer roller 38 is brought in pressure contact with receiving medium 36, e.g. paper, at temperature T2. Temperature T2 can be in the range of 70–115 degrees Celsius and, preferably is about 115 degrees Celsius. Under the applied pressure 95 pounds per square inch (32 kilograms per centimeters squared), the developer image bearing elastomer of transfer roller 38, preferably a rigid metal roller, conforms to the topography of the receiving medium 36 so that every part of the developer image, including small dots, can come into contact with the surface of receiving medium 36 and transfer to receiving medium 36.

The elastomer of transfer roller 38 has sufficient adhesive properties at temperature T1 to pick up the semi-dry developer image from the surface of photoreceptor surface. Further, the elastomer of transfer roller 38 has sufficient release properties at temperature T2 to allow film form developer image to be released to receiving medium 36. The elastomer of transfer roller 38 is able to conform to the irregularities in the surface of receiving medium 36, e.g., the irregularities of rough paper. Conformability is accomplished by using an elastomer having a Shore A Durometer hardness of about 65 or less, preferably 50. Preferably, the elastomer should be resistant to swelling and attack by the carrier medium, e.g., hydrocarbon, for developers 24*a*–24*d*. The elastomer of transfer roller 38 has an adhesive characteristic relative to developers 24*a*–24*d* that is greater than the adhesive characteristic of developers 24*a*–24*d* and release surface of receptor material 10 at temperature T1, but less than the adhesive characteristic of developers 24*a*–24*d* and final receiving medium 36 at temperature T2. The choice of the elastomer of transfer roller 38 is dependent on the release surface of receptor material 10, the composition of developers 24*a*–24*d*, and receiving medium 36. For the process described here, several fluorosilicone elastomers meet these requirements, e.g., Dow Corning 94-003 fluorosilicone dispersion coating, available from Dow Corning Corporation, Midland, Mich.

One type of developer found particularly suitable for use as developers 24*a*–24*d* consists of liquid ink materials that are substantially transparent and of low absorptivity to radiation from laser scanning device 20. This allows radiation from laser scanning device 20 to pass through the previously deposited ink or inks and impinge on the surface of receptor material 10 and reduce the deposited charge. This type of ink permits subsequent imaging to be effected through previously developed ink images as when forming a second, third, or fourth color plane without consideration for the order of color deposition. It is preferable that the inks transmit at least 80% and more preferably 90% of radiation from laser scanning device 20 and that the radiation is not significantly scattered by the deposited color planes.

One type of ink found particularly suitable for use as developers 24*a*–24*d* are gel organosols which exhibit excellent imaging characteristics in liquid immersion development. For example, the gel organosol developers exhibit low bulk conductivity, low free phase conductivity, low charge/mass and high mobility, all desirable characteristics for producing high resolution, background free images with high optical density. In particular, the low bulk conductivity, low free phase conductivity and low charge/mass of the inks allow them to achieve high developed optical density over a wide range of solids concentrations, thus improving their extended printing performance relative to conventional inks.

These color developers on development form colored films which transmit incident radiation such as, for example, near infrared radiation, consequently allowing the photoconductor layer to discharge, while non-coalescent particles scatter a portion of the incident light. Non-coalesced ink particles therefore result in the decreasing of the sensitivity of the photoconductor to subsequent exposures and consequently there is interference with the overprinted image.

These liquid inks have low $T_g$ values which enable the inks to form films at room temperature. The designation $T_g$ corresponds to the glass transition temperature where a partially crystalline polymer changes from a viscous or rubbery condition to a hard and relatively brittle one. Normal room temperature (19–20 degrees Celsius) is sufficient to enable film forming and, of course, the ambient internal temperatures of the apparatus during operation which tends to be at a higher temperature (e.g., 25–40 degrees Celsius) even without specific heating elements is sufficient to cause the ink or allow the ink to form a film.

Residual image tack after transfer may be adversely affected by the presence of high tack monomers, such as ethyl acrylate, in the organosol. Therefore, the organosols are generally formulated such that the organosol core preferably has a glass transition temperature ($T_g$) less than room temperature (25 degrees Celsius) but greater than minus 10 degrees Celsius. A preferred organosol core composition contains about 75 weight percent ethyl acrylate and 25 weight percent methyl methacrylate, yielding a calculated core $T_g$ of=minus 1 degree Celsius. This permits the developers to rapidly self-fix under normal room temperature or higher development conditions and also produce tack-free fixed images which resist blocking.

The carrier liquid may be selected from a wide variety of materials which are well known in the art. The carrier liquid is typically oleophilic, chemically stable under a variety of conditions, and electrically insulating. "Electrically insulating" means that the carrier liquid has a low dielectric constant and a high electrical resistivity. Preferably, the carrier liquid has a dielectric constant of less than 5, and still more preferably less than 3. Examples of suitable carrier liquids are aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents.

Preferred carrier liquids include paraffinic solvent blends sold under the names Isopar G liquid, Isopar H liquid, Isopar K liquid and Isopar L liquid (manufactured by Exxon Chemical Corporation, Houston, Tex.). The preferred carrier liquid is Norpar-12 liquid, also available from Exxon Corporation.

The toner particles are comprised of colorant embedded in a thermoplastic resin. The colorant may be a dye or more preferably a pigment. The resin may be comprised of one or more polymers or copolymers which are characterized as being generally insoluble or only slightly soluble in the carrier liquid; these polymers or copolymers comprise a resin core. In addition, superior stability of the dispersed toner particles with respect to aggregation is obtained when at least one of the polymers or copolymers (denoted as the stabilizer) is an amphipathic substance containing at least one chain-like component of molecular weight of at least 500 which is solvated by the carrier liquid. Under such conditions, the stabilizer extends from the resin core into the carrier liquid, acting as a steric stabilizer as discussed in *Dispersion Polymerization* (Ed. Barrett, Interscience., p. 9 (1975)). Preferably, the stabilizer is chemically incorporated into the resin core, i.e., covalently bonded or grafted to the core, but may alternatively be physically or chemically adsorbed to the core such that it remains as an integral part of the resin core.

The composition of the resin is preferentially manipulated such that the organosol exhibits an effective glass transition temperature (Tg) of less than 25 degrees Celsius (more preferably less than 6 degrees Celsius), thus causing a developer composition of developers 24*a*–24*d* containing the resin as a major component to undergo rapid film formation (rapid self fixing) in printing or imaging processes carried out at temperatures greater than the core Tg (preferably at or above 25 degrees Celsius). The use of low Tg resins to promote rapid self fixing of printed or toned images is known in the art, as exemplified by *Film Formation*, Z. W. Wicks, Federation of Societies for Coatings Technologies, p. 8 (1986). Rapid self fixing is thought to avoid printing defects (such as smearing or trailing-edge tailing) and incomplete transfer in high speed printing. For printing on plain paper, it is preferred that the core Tg be greater than minus 10 degrees Celsius and, more preferably, be in the range from minus 5 degrees Celsius to plus 5 degrees Celsius so that the final image is not tacky and has good block resistance.

Examples of resin materials suitable for use in developers 24a–24d include polymers and copolymers of (meth)acrylic esters; including methyl acrylate, ethyl acrylate, butyl acrylate, ethylhexyl acrylate, 2-ethylhexylmethacrylate, lauryl acrylate, octadecyl acrylate, methyl(methacrylate), ethyl (methacrylate), lauryl methacrylate, hydroxy (ethylmethacrylate), octadecyl(methacrylate) and other polyacrylates. Other polymers may be used in conjunction with the aforementioned materials, including melamine and melamine formaldehyde resins, phenol formaldehyde resins, epoxy resins, polyester resins, styrene and styrene/acrylic copolymers, acrylic and methacrylic esters, cellulose acetate and cellulose acetate-butyrate copolymers, and poly(vinyl butyral) copolymers.

The colorants which may be used in developers 24a–24d include virtually any dyes, stains or pigments which may be incorporated into the polymer resin, which are compatible with the carrier liquid, and which are useful and effective in making visible the latent electrostatic image. Examples of suitable colorants include: Phthalocyanine blue (C.I. Pigment Blue 15 and 16), Quinacridone magenta (C.I. Pigment Red 122, 192, 202 and 206), Rhodamine YS (C.I. Pigment Red 81), diarylide (benzidine) yellow (C.I. Pigment Yellow 12, 13, 14, 17, 55, 83 and 155), and arylamide (Hansa) yellow (C.I. Pigment Yellow 1, 3, 10, 73, 74, 97, 105 and 111); organic dyes, and black materials such as finely divided carbon and the like.

The optimal weight ratio of resin to colorant in the toner particles is on the order of 1/1 to 20/1, most preferably between 10/1 and 3/1. The total dispersed "solid" material in the carrier liquid typically represents 0.5 to 20 weight percent, most preferably between 0.5 and 3 weight percent of the total liquid developer composition.

Developers 24a–24d include a soluble charge control agent, sometimes referred to as a charge director, to provide uniform charge polarity of the toner particles. The charge director may be incorporated into the toner particles, may be chemically reacted to the toner particle, may be chemically or physically adsorbed onto the toner particle (resin or pigment), and may be chelated to a functional group incorporated into the toner particle, preferably via a functional group comprising the stabilizer. The charge director acts to impart an electrical charge of selected polarity (either positive or negative) to the toner particles. Any number of charge directors described in the art may be used herein; preferred positive charge directors are the metallic soaps. See U.S. Pat. No. 3,411,936, Rotsman et al. The preferred charge directors are polyvalent metal soaps of zirconium and aluminum, preferably zirconium octoate. The particular developers 24a–24d preferred are described with more particularity in U.S. Pat. No. 5,652,282 entitled Liquid Inks Using a Gel Organosol.

With the electrophotographic system of the illustrated embodiment, developers 24a–24d contain conventional "solid" colored toner particles and also contain transparent counter-ions. The conventional "solid" colored toner particles in developers 24a–24d plate to the surface of receptor material 10 while the transparent counter-ions in developers 24a–24d plate in the opposite direction, i.e., the transparent counter-ions plate to the surface of receptor material 10 in areas 30 (see 28a–28d) which are not discharged. Conventional "solid" colored toner particles in developers 24a–24d plate to electrodes 26a–26d, respectively, in charged areas 30 while transparent counter-ions plate to electrodes 26a–26d in areas 28a–28d, respectively.

Prior to development, receptor material 10 is charged similarly by charging device 18, after which receptor material 10 may be exposed image-wise to radiation such as from laser scanning device 20 such that the charge distribution over the surface of receptor material 10 is rendered proportional to predetermined image information. Then developers 24a–24d are applied to the charge distribution on the receptor material 10 in the presence of a well-controlled electric field provided by liquid developer stations 22a–22d. This deposits a solid material of predetermined color planes onto the surface of receptor material 10 which is distributed in a manner which is proportional to the predetermined image information. In like manner, transparent counter-ions are deposited onto the surface of receptor material 10 in a distribution which is inversely proportional to the predetermined image information. The presence of such counter-ions provides a charge distribution on the surface of the photoreceptor as it leaves the electric field which is well controlled and substantially uniform and is not substantially modulated by the image-wise distribution which was on the surface as it entered the electric field. This process, which effectively "develops" an image of a prescribed color serves as the charging means for a next color plane such that conventional erase and charge means (such as from an erase lamp and a charging corona) are not required in order to expose and develop a next color plane.

Figure 7A:
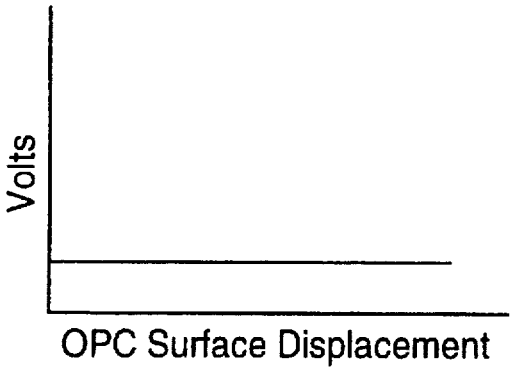
FIG. 7A is a graph illustrating the surface charge of the organic photoreceptor of FIGS. 1 and 2 existing after erase and before charging.
Figure 7B:
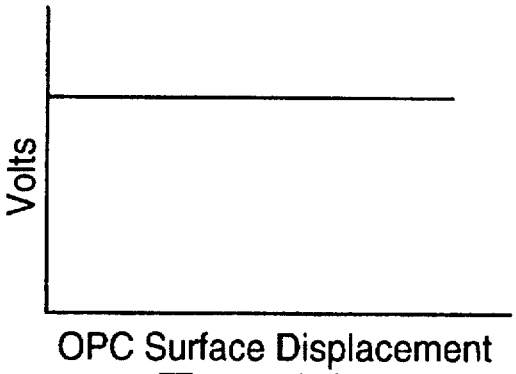
FIG. 7B is a graph illustrating the surface charge of the organic photoreceptor of FIGS. 1 and 2 existing after charging and before image-wise exposure.
Figure 7C:
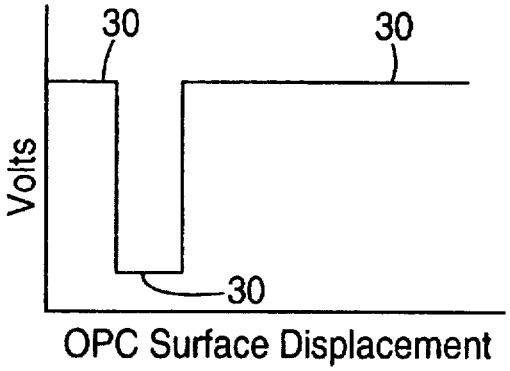
FIG. 7C is a graph illustrating the surface charge of the organic photoreceptor of FIGS. 1 and 2 existing after image-wise exposure and before development.
Figure 7D:
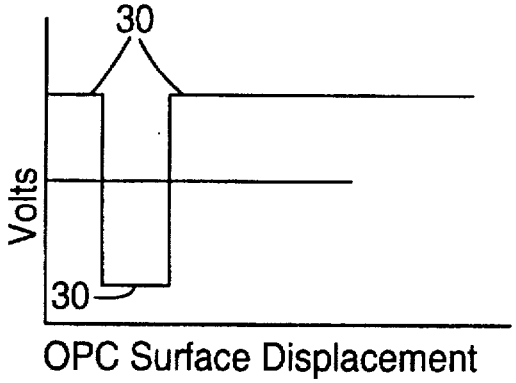
FIG. 7D is a graph illustrating the surface charge of the organic photoreceptor of FIGS. 1 and 2 existing during development.
Figure 7E:
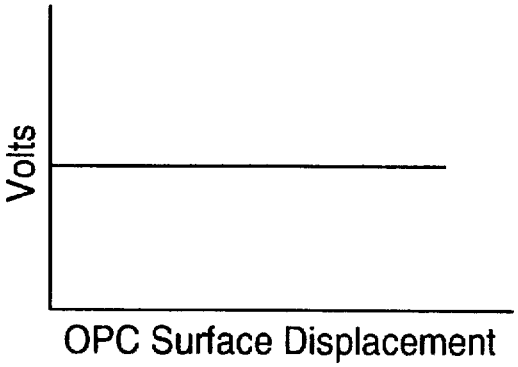
FIG. 7E is a graph illustrating the surface charge of the organic photoreceptor of FIGS. 1 and 2 existing after development.

This solution-charge-exchange charging of receptor material 10 is illustrated in FIGS. 7A, 7B, 7C, 7D and 7E. As illustrated in FIG. 7A, the surface of receptor material 10 after erase and before corona charging is uniform and low, preferably nearly zero. As illustrated in FIG. 7B, the surface of receptor material 10 after corona charging and before image-wise exposure is uniform and high, preferably about 600 volts depending on the capacitance of the photoreceptor. As illustrated in FIG. 7C, the surface of receptor material 10 after image-wise exposure is discretely variable with areas 28a–28d having been exposed to radiation having been discharged to a quite low level and areas 30 which have not been exposed to radiation still remaining at a high voltage, again preferably near 600 volts depending upon capacitance. As illustrated in FIG. 7D, the surface of receptor material 10 during development shows that as solids in developer 24 plate onto the surface of receptor material 10 in areas 28a–28d, charge migration causes the voltage existing on the surface of receptor material 10 to increase. As solids from developers 24a–24d in areas 30 plate onto electrode 26a–26d, respectively, charge migration causes the voltage existing on the surface of receptor material 10 to decrease. The result, illustrated in FIG. 7E, shows that the surface of receptor material 10 after development is relatively uniform and equal to the bias voltage level of electrode 26a–26d.

The above described liquid electrophotographic process is suitable for construction of a multi-colored image, but the receptor material 10 must repeat the entire sequence for each color of the typical four color colored image, while maintaining registration of each color planes to within 100 micrometers. It has been found that the drive mechanism for rotating the drum 12 can have a substantial impact on the quality of the resulting image. The images are typically formed from about 600 scan lines per inch (each scan line being about 43 micrometers wide). A shift of scan lines in excess of about 100 micrometers is visible to the naked eye. Additionally, dry toner pigment particles are about 10 times larger than wet toner pigment particles. Consequently, alignment of image planes using the present liquid electrophotography process requires higher resolution.

Figure 3:
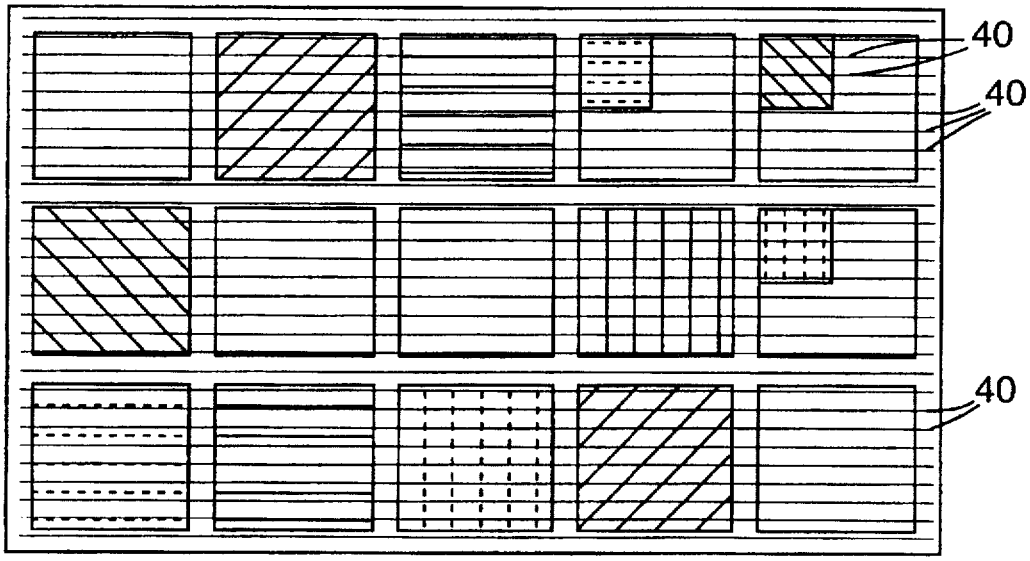
FIG. 3 is an exemplary image exhibiting banding generated using the electrographic apparatus of FIG. 1.

Gear driven drive mechanisms tend to produce images with bands 40 of concentrated or displaced raster lines, such as illustrated in the test image of FIG. 3. Banding refers to non-uniform placement of laser scan lines along the length of an image. For example, on images having 600 scan lines per inch (236 scan lines/centimeter), two or more scan lines closer than the nominal 43 micrometers can cause visible banding. It is believed that this "banding" is due in part to chatter at the interface between interlocking gears in the drive mechanism, as well as other factors.

Figure 4:
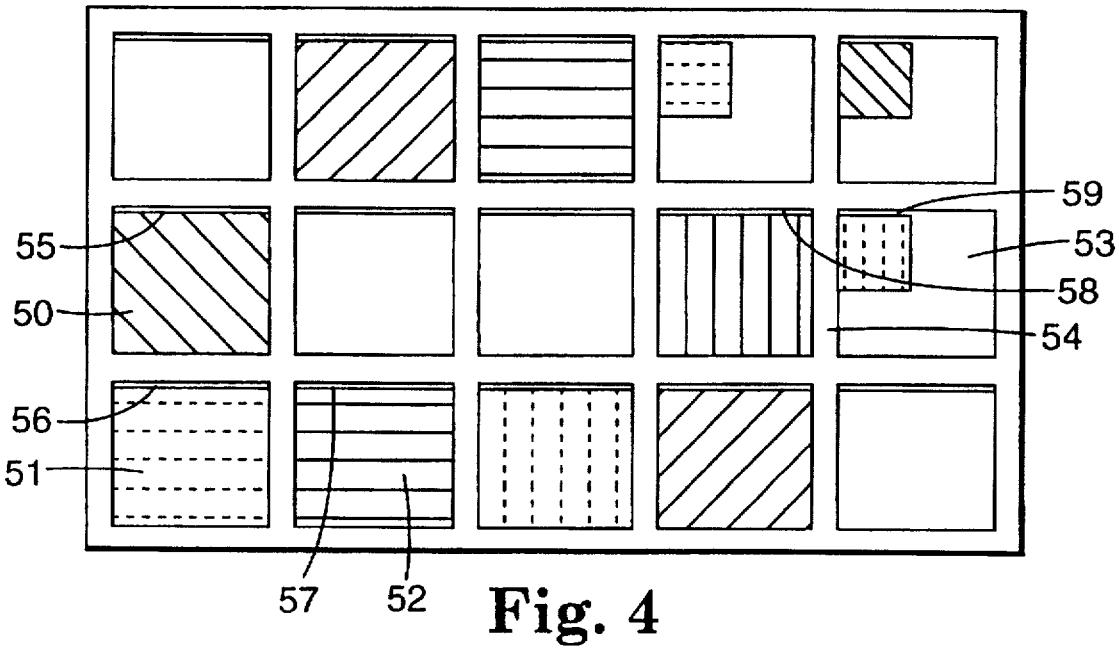
FIG. 4 is an exemplary image exhibiting misregistration of the image planes generated using the electrographic apparatus of FIG. 1.

While belt-driving drive mechanisms tend to reduce banding in the image, it can be difficult to maintain registration of each color plane over the course of multiple drum rotations. Misregistration of color test cells 50–54 in the test image of FIG. 4 is visible at locations 55–59. Such misregistration is believed to be due in part to belt slippage, lack of concentricity of the belt pulleys, and other factors.

Figure 5:
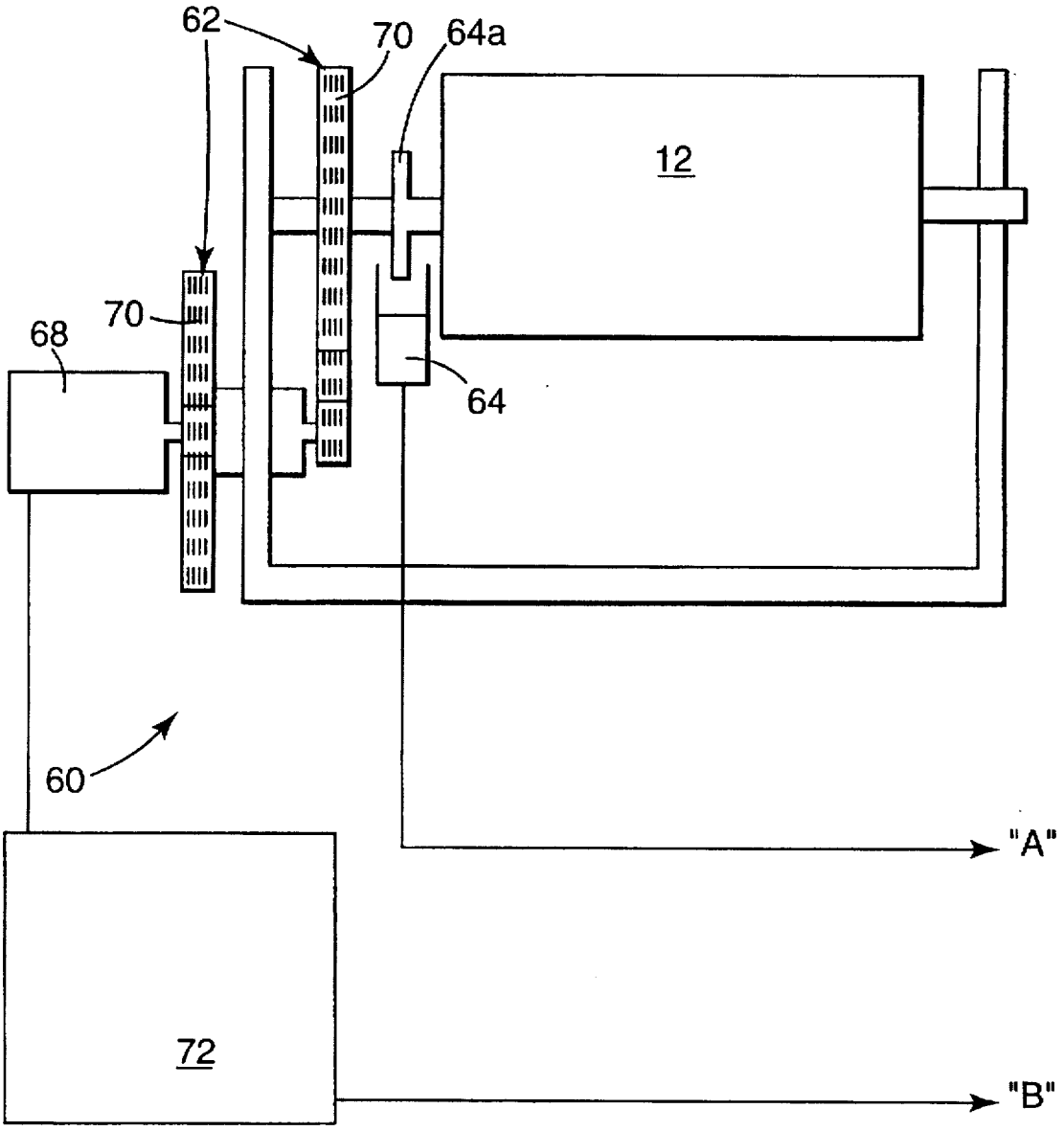
FIG. 5 is a schematic illustration of an exemplary drive mechanism for use with the present image band reduction and image plane alignment system.
Figure 6:
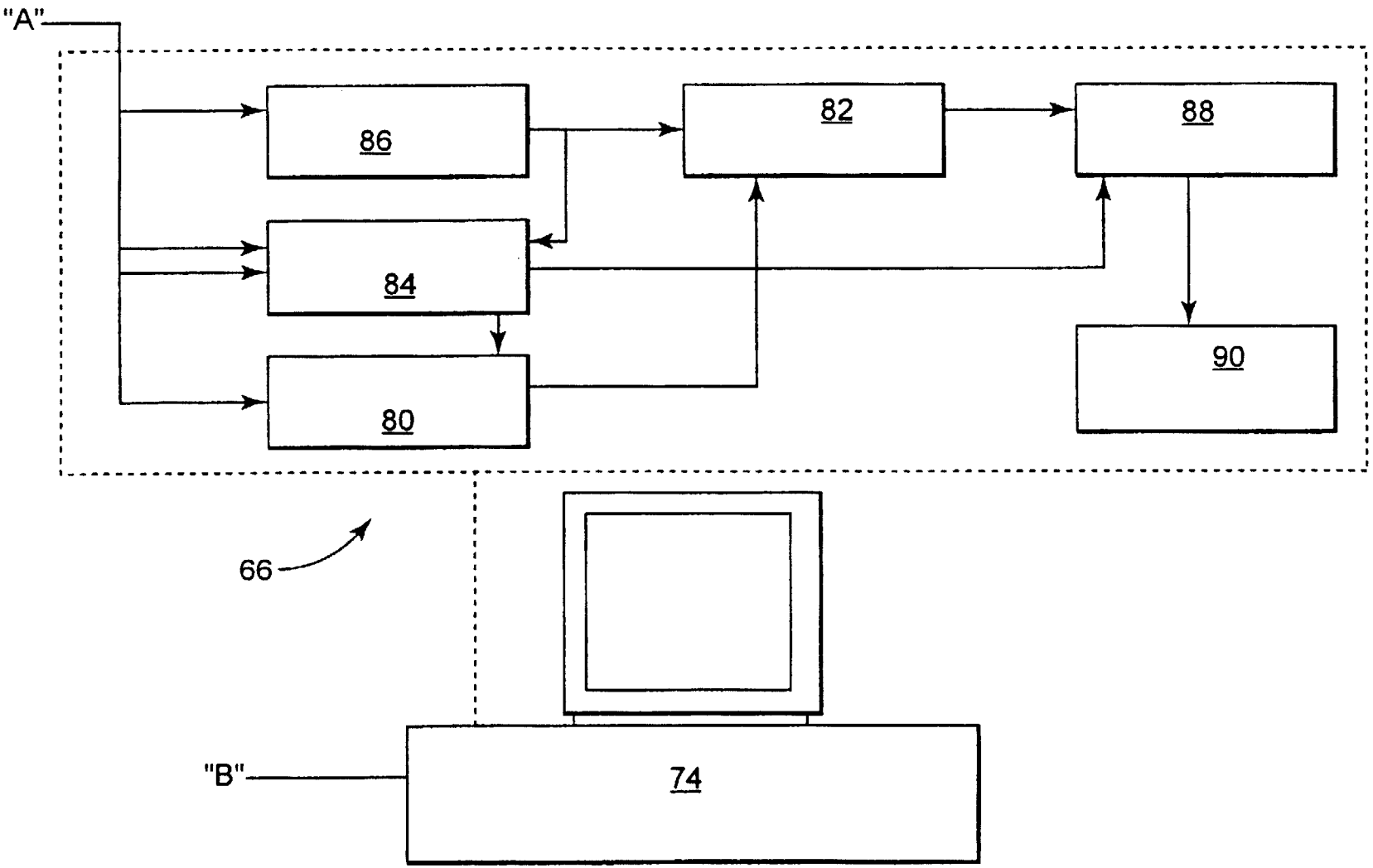
FIG. 6 is a schematic illustration of an exemplary closed loop positioning system for use with the present image band reduction and image plane alignment system.

FIGS. 5 and 6 illustrate an exemplary embodiment of the present image plane registration system 60 for electrophotographic printing. Belt driven drive mechanism 62 couples a stepper motor 68 to the drum 12. In the illustrated embodiment, the motor to drum ratio is about 25:1. The drive belts 70 are preferably a triple v-belt construction. The drive belt 70 used in the present embodiment of the image plane registration system 60 is a Poly-V Belt type "J" available from Goodyear. The stepper motor and controller used in the present embodiment is available from Compu-Motor as model Nos. S83-135-MC and SX-6. In the present embodiment, the receptor drum 10 typically travels at about 7.6 centimeters/second (3 inches/second).

An encoder disk 64*a* mounted on the drum 12 rotates in an encoder reader 64 to provide drum position data for servo position in control system 66. In the present embodiment, the encoder is a conventional optical pulse counter having two channels (channel A and channel B) each generating 1024 pulses per revolution and a reference or index pulse for each revolution.

The closed loop positioning system 66 has a detector 80 for detecting an encoder index pulse to provide a known drum 12 starting position. The encoder 64 generates two pulse streams in channel A and channel B, preferably 90 degrees out of phase. The pulses from channels A and B from the encoder 64 are directed to an encoder clock frequency doubler 84. The two encoder channels (1024 counts/revolution each) are electronically combined to form a single channel of 2048 pulses per revolution.

In the illustrated embodiment, the drum 12 has a circumference of 19.79 inches and a surface speed of 3 inches/second. Image resolution is 600 scan lines/inch or 11,868 scan lines/drum revolution. The mastering mirror of the laser scanning device 20 is preferably rotated at a constant angular velocity. A start-of-line (SOL) pulse is generated at the beginning of each scan line. Consequently, there are about 5.8 scan lines/encoder pulse. Since the counter 82 can only count integer values, SOL pulses are multiplied by 100 in phase lock loop 86, resulting in about 580 counts/encoder pulse or 100 counts/scan line. The resulting resolution of the system 66 is about ±0.01 scan lines/encoder pulse. Accumulation of error is minimized by not resetting the counter after every encoder pulse.

When the reference pulse (index) from the encoder 64 is detected, the counter 82 starts counting SOL pulses times 100. During a print cycle (which is typically multiple drum revolutions), counter 82 data is latched at every encoder pulse and passed onto the computer 74 through communications port 90. The counter 82 is typically not reset during a print cycle to avoid accumulating the error of about ±0.01 scan lines/encoder pulse. The computer 74 reads the data and compares it to a calibration table (discussed below) to determine position of the drum 12 as well as the velocity change error values used to vary the speed of the motor 68. The necessary velocity changes of the drive motor 68 to correct for positioning errors in the drum 12 are transmitted to the motor servo 72.

The closed loop positioning system 66 is calibrated to document encoder variability. In the illustrated embodiment, the encoder is a low-cost disc stamped from metal that can exhibit considerable variability. The encoder 64 and drum 12 are rotated at a reference velocity (e.g., about 7.62 centimeters/second) until the reference pulse is detected by the reference detector 80. The reference pulse is used to determine the drum position and to generate a top of form signal for printing. When the reference position is detected, the software enters a data collection routine, where the software waits until data is ready. Data correlating actual scan lines per encoder pulse is saved in a data array. The drum 12 and encoder 64 are rotated for one or more revolutions. If more than one revolution of the drum 12 and encoder 64 is specified, each of the accumulated 2048 table values in the array is divided by the number of revolutions to generate an average value for each table entry. After all the data has been processed, the table will be written to a calibration file and the encoder 64 and drum 12 will be stopped. The calibration table corrects for variations in the encoder line spacing error that may occur due to encoder manufacturing tolerances and other mechanical errors in the system 60.

When the system 60 is activated, the motor servo 72 will rotate the drum 12 until the reference signal is located. The computer 74 performs a data collection and error computation loop. The loop begins by checking if data is ready. If data is present, the computer 74 will read the actual position data from the register 88. The computer will also read the predicted encoder position data from the calibration array. From these two running totals, the computer 74 will determine if there is a drum position error. If a drum position error is detected, the computer 74 calculates a velocity correction. The velocity correction is sent to the motor servo 72. The motor servo 72 maintains the drum position based on a line count with reference to the drum position information recorded by the encoder 64. The drum speed is adjusted by the motor servo 72 based on a line count per encoder pulse to achieve image plane registration.

In an alternate embodiment, the motor 72 and the positioning system 66 drive the drum 12 open loop for printing the first image plane. The computer 74 records the scan line count per encoder pulses for that first revolution of the drum 12. All subsequent revolutions of the drum 12 for subsequent image planes are controlled according to the scan lines per encoder pulses recorded during the first revolution of the drum 12. That is, the scan lines per encoder pulse recorded during the first revolution of the drum 12 operate as a temporary calibration table that is used to servo the motor 68 during formation of subsequent image planes for that particular image.

All patent and patent applications, including those disclosed in the background of the invention, are hereby incorporated by reference. The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

What is claimed is:

1. A system for registering multiple image planes of a single image in an electrographic system, comprising:

a receptor drum capable of capturing two or more overlaying image planes;

an exposure device for forming overlaying image planes on the receptor drum;

at least one developer station for transferring a developer to the receptor drum corresponding to each of the overlaying image planes;

a measuring device for measuring the rotational position of the receptor drum;

a drive mechanism for controlling a motor coupled to the receptor drum by at least one drive belt; and a closed loop positioning system coupled to the measuring device and the drive mechanism, the closed loop positioning system being capable of modulating the angular velocity of the receptor drum to achieve image plane registration of the two or more image planes.

2. The system of claim 1 wherein the closed loop positioning system is capable of achieving image plane registration error of about 100 micrometers or less.

3. The system of claim 1 wherein the closed loop positioning system is capable of achieving image plane registration error of about 50 micrometers or less.

4. The system of claim 1 wherein the closed loop positioning system is capable of achieving image plane registration error of about 20 micrometers or less.

5. The system of claim 1 wherein the closed loop positioning system is capable of achieving image plane registration error of about ±0.5 scan lines or less.

6. The system of claim 1 wherein the exposure device is capable of forming one image plane for each rotation of the receptor drum.

7. The system of claim 1 wherein the two or more overlaying image planes comprise at least three image planes each formed during separate rotations of the receptor drum.

8. The system of claim 1 wherein the two or more overlaying image planes comprise at least four image planes each formed during separate rotations of the receptor drum.

9. The system of claim 1 wherein the electrographic system comprises an electrophotographic system and the receptor drum comprises a photoreceptor drum.

10. The system of claim 1 wherein the electrographic system comprises an electrostatic system and the receptor drum comprises an electrostatic drum.

11. The system of claim 1 wherein the developer comprises a wet developer.

12. The system of claim 1 wherein the developer comprises a dry developer.

13. The system of claim 1 wherein the exposure device comprises a rastering laser system.

14. The system of claim 1 wherein the developer stations comprise means for engaging and disengaging with the receptor drum.

15. The system of claim 1 wherein the developer stations comprise drying means for substantially transforming developer on the receptor drum into a substantially dry film.

16. The system of claim 1 wherein the measuring device comprises a positioning encoder.

17. The system of claim 1 wherein the closed loop positioning system comprises a calibration table correlating a location of scan lines on the receptor drum from the exposure device with a position pulse from the measuring device.

18. The system of claim 17 wherein the calibration table is generated during formation of a first overlapping image plane.

19. The system of claim 17 wherein the closed loop positioning system is capable of comparing an actual position of the receptor drum as measured by the measuring device with a predicted position of the receptor drum from the calibration table to calculate a velocity correction to achieve image plane registration.

20. The system of claim 1 comprising a charging device capable of depositing a generally uniform positive or negative charge upon the receptor drum.

21. The system of claim 1 comprising a transfer mechanism for transferring the two or more image planes from the receptor drum to a receiving medium.

22. A method for registering multiple image planes of a single image in an electrographic system, comprising the steps of:

rotating a receptor drum while measuring its rotational position;

directing an exposure device to the rotating receptor drum to form a first image plane;

engaging a first developer station with the receptor drum to transfer a first developer to the receptor drum corresponding to the first image plane;

transforming the first developer on the receptor drum into a substantially dry film;

directing an exposure device to the rotating receptor drum to form a second overlaying image plane;

modulating the angular velocity of the receptor drum to achieve image plane registration of the second image plane with the first image plane;

engaging a second developer station with the receptor drum to transfer a second developer to the receptor drum corresponding to the second image plane; and transforming the second developer on the receptor drum into a substantially dry film.

23. The method of claim 22 further comprising the step of coupling a closed loop positioning system to a measuring device on the receptor drum and a drive mechanism for rotating the receptor drum.

24. The method of claim 22 wherein the closed loop positioning system achieves image plane registration error of about 100 micrometers or less.

25. The method of claim 22 wherein the closed loop positioning system achieves image plane registration error of about 50 micrometers or less.

26. The method of claim 22 wherein the closed loop positioning system achieves image plane registration error of about 20 micrometers or less.

27. The method of claim 22 wherein the closed loop positioning system achieves image plane registration error of about ±0.5 scan lines or less.

28. The method of claim 22 wherein the exposure device forms one image plane for each rotation of the receptor drum.

29. The method of claim 22 wherein the electrographic system comprises an electrophotographic system and the receptor drum comprises a photoreceptor drum.

30. The method of claim 22 wherein the electrographic system comprises an electrostatic system and the receptor drum comprises an electrostatic drum.

31. The method of claim 22 wherein the developer comprises a wet developer.

32. The method of claim 22 wherein the developer comprises a dry developer.

33. The method of claim 22 wherein the first image plane is formed during a first rotation of the receptor drum and the second image plane is formed during a second rotation of the receptor drum.

34. The method of claim 22 comprising the step of transferring the dry developer from the first and second image planes from the receptor drum to a receiving medium.

35. The method of claim 22 further comprising the steps of:

directing an exposure device to the rotating receptor drum to form a third overlaying image plane;

modulating the angular velocity of the receptor drum to achieve image plane registration of the third image plane with the first and second image planes;

engaging a third developer station with the receptor drum to transfer developer to the receptor drum corresponding to the third image plane; and transforming developer on the receptor drum into a substantially dry film.

36. The method of claim 35 further comprising the steps of:

directing an exposure device to the rotating receptor drum to form a fourth overlaying image plane;

modulating the angular velocity of the receptor drum to achieve image plane registration of the fourth image plane with the first, second and third image planes;

engaging a fourth developer station with the receptor drum to transfer developer to the receptor drum corresponding to the fourth image plane; and transforming developer on the receptor drum into a substantially dry film.

37. The method of claim 22 wherein the step of directing an exposure device to the rotating receptor drum comprises directing a rastering laser at the receptor drum.

38. The method of claim 22 further comprising the step of charging the receptor drum between the step of transforming developer on the receptor drum into a substantially dry film and the step of directing an exposure device to the rotating receptor drum to form a second overlaying image plane.

39. The method of claim 22 comprising the steps of:

rotating the receptor drum during a calibration cycle;

correlating a location of scan lines on the receptor drum with position pulses from a measuring device; and storing correlated position data in a calibration table.

40. The method of claim 39 comprising the steps of:

comparing an actual position of the receptor drum with correlated position data in the calibration table;

calculating a velocity correction to achieve image plane registration; and changing the velocity of the receptor drum to register the image planes.

41. The method of claim 39 wherein the calibration table is generated during formation of a first overlapping image plane.

* * * * *